United States Patent [19]

Shinozaki et al.

[11] 4,403,563

[45] Sep. 13, 1983

[54] ELECTRIC SEWING MACHINE DRIVING APPARATUS

[75] Inventors: Nozomu Shinozaki, Hirakata; Shigeo Neki, Osaka; Takashi Dohi, Hirakata, all of Japan

[73] Assignee: Matsushita Electric Industrial Co., Ltd., Osaka, Japan

[21] Appl. No.: 287,075

[22] Filed: Jul. 21, 1981

[30] Foreign Application Priority Data

Jul. 31, 1980 [JP] Japan ..... 55-106099

[51] Int. Cl.[3] ..... D05B 69/22

[52] U.S. Cl. ..... 112/275

[58] Field of Search ..... 112/275, 277; 318/369, 318/466, 467

[56] References Cited

U.S. PATENT DOCUMENTS

| | | | |
|---|---|---|---|
| 4,161,921 | 7/1979 | Nishida et al. | 112/275 |
| 4,195,582 | 4/1980 | Novick | 112/275 X |
| 4,351,254 | 9/1982 | Brown | 112/275 X |

*Primary Examiner*—Peter P. Nerbun

*Attorney, Agent, or Firm*—Spencer, Kaye & Frank

[57] ABSTRACT

An electric sewing machine driving apparatus includes a clutch coil of an electromagnetic clutch for transmitting a driving motor torque to a sewing machine, a brake coil of an electromagnetic brake for braking the sewing machine, a needle position signal generator for generating a signal indicative of a position where a needle of the sewing machine is to stop, a DC power supply for energizing the clutch coil and the brake coil, voltage generating means for generating a DC voltage higher than the supply voltage of the DC power supply and a capacitor disposed to be charged by the voltage generated by the voltage generating means, whereby an electric charge stored in the capacitor discharges through the brake coil in response to the needle position signal from the needle position signal generator, thereby improving the needle positioning accuracy of the sewing machine.

6 Claims, 4 Drawing Figures

ELECTRIC SEWING MACHINE DRIVING APPARATUS

The present invention relates to an industrial electric sewing machine driving apparatus including an electromagnetic clutch mechanism for transmitting the torque of a motor to a sewing machine to drive it and an electromagnetic brake mechanism for applying a braking force to the sewing machine.

Conventional electromagnetic clutch and brake mechanisms of the above type have the structure such that a clutch ring and a brake ring, each thereof comprising a friction member made of cork, etc., are arranged movably in the axial direction so that the torque of a continuously operating motor is transmitted to an output shaft or the output shaft is braked through the friction member actuated by an electromagnetic force. For this purpose, the mechanism includes a pair of coils, namely, a clutch coil and a brake coil, so that the output shaft is accelerated when the clutch coil is energized and the output shaft is decelerated when the brake coil is energized.

In recent years, control techniques for industrial electric sewing machines have made rapid progress and the efficiency of the sewing operation has been elevated remarkably. This is attributable to the yearly development of the logical techniques including the progress from ICs to LSIs and further to microcomputers and consequently it has become possible to control as desired the clutch coil and the brake coil as well as various sewing machine controlling solenoids such as a thread trimming solenoid, thread wiping solenoid, back tacking solenoid and a pressure foot lifting solenoid in relation to the machine speed and the needle position. However, each of the coils and solenoids has its inherent inductance, so that a delay appears naturally in its on-off operations thereby deteriorating the controllability of the machine considerably. Particularly, since the clutch and brake mechanisms comprise the axially movable clutch and brake rings as mentioned above, the delays in the operations of the clutch and brake coils give rise to fatal deficiencies including the unstable speed control and the deterioration of accuracy of the predetermined needle position stopping operation, etc. More particularly, a delay in the rise of an electric current flowing through the brake coil when it is energized causes, in turn, a delay of a braking force to be applied, which increases the deviation of the actual stopping position from the position of the generation of a stop signal associated, thus presenting a dominant cause of the deterioration of accuracy of the predetermined needle position stopping operation.

With a view to overcoming the foregoing deficiencies in the prior art, it is the object of the present invention to provide an improved electric sewing machine driving apparatus so designed that an electric power discharged from a capacitor, which has been charged beforehand to a high voltage, is applied to a brake coil to decrease the deviation of the actual stopping position from the position of the stop signal generation, thereby raising accuracy of the predetermined needle position stopping operation.

The above and other objects, advantages and features of this invention will become more apparent from the following detailed descriptions taken in conjunction with the accompanying drawings, in which.

In the following descriptions made with reference to the accompanying drawings, firstly general operational characteristics of the electric control of an industrial electric sewing machine will be described with reference to the time chart of FIG. 1, and the deficiencies appearing in the operational characteristics of the electric control of a conventional industrial electric sewing machine in an operational range from its thread trimming operation to its stop will be described with reference to the time chart of FIG. 2. Next, the improvements of the operational characteristics shown in FIG. 2 made by the application of the present invention will be described with reference to the time chart of FIG. 3, and lastly the construction and operation of an electric circuit of an industrial electric sewing machine driving apparatus embodying the present invention will be described with reference to the circuit diagram of FIG. 4.

Figure 1:
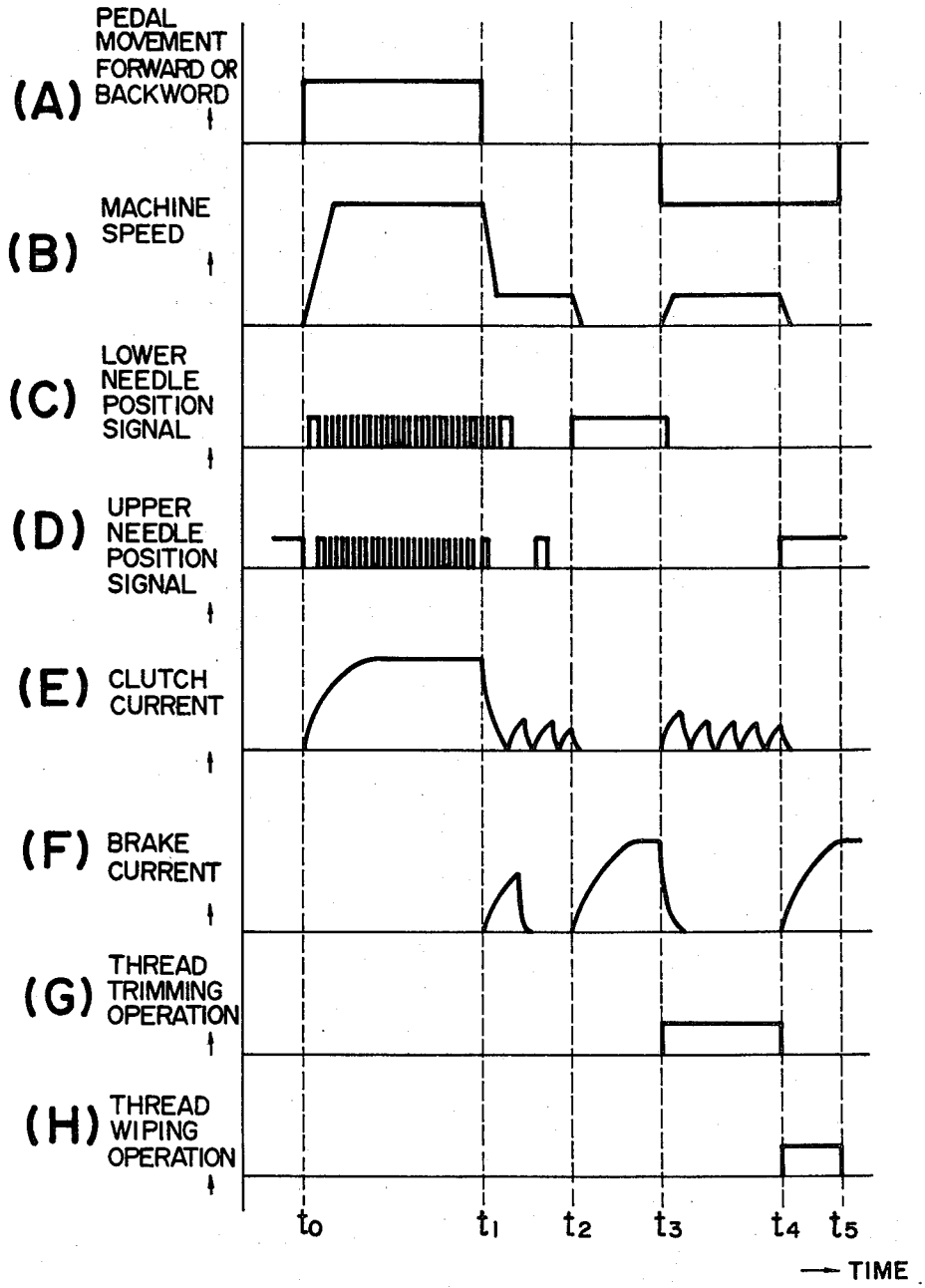
FIG. 1 is a diagram showing general operational characteristics of an industrial electric sewing machine.

Referring to FIG. 1 showing a general operational pattern in the control of an industrial electric sewing machine, when a pedal of the machine is forwardly depressed at a time $t_0$, a clutch current flows and the machine speed is increased. When the pedal is restored to its neutral position at a time $t_1$, the clutch current decreases and a brake current flows. When this occurs, the sewing machine is decelerated rapidly and the clutch current is switched on and off to cause the machine to operate stably at a low speed. Then, a lower needle position signal is generated at a time $t_2$ so that the clutch current is decreased and the brake current flows again, and the machine stops at a lower needle position. Thereafter, if the pedal is depressed backwardly at a time $t_3$, the machine operates again at the low speed and a thread trimming operation is performed. Then, after about one half rotation, an upper needle position signal is generated at a time $t_4$ so that the clutch current is decreased and the brake current flows again, whereby the machine stops at an upper needle position and simultaneously a thread wiping operation is performed. This thread wiping operation is usually completed within about several tens milliseconds.

Figure 2:
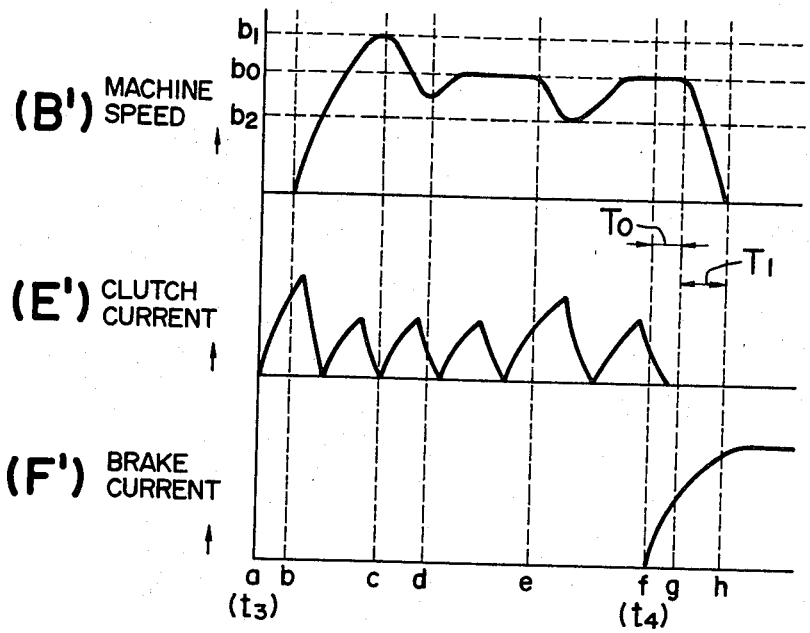
FIG. 2 is a diagram showing operational characteristics of a conventional industrial electric sewing machine in an operational range from its thread trimming operation to its stop.

FIG. 2 shows in greater detail the time interval from $t_3$ to $t_4$ in FIG. 1 with respect to the machine speed, clutch current and brake current, and the deficiencies of the operation of a conventional machine will now be described with reference to FIG. 2.

When the pedal is depressed backwardly at a time a (corresponding to the time $t_3$ in FIG. 1), the clutch is energized immediately, so that a current starts to flow through the clutch coil and increases in proportion to the inductance of the clutch coil. Due to a delay in the rise of the clutch current and the corresponding delay in the movement of the clutch ring, the machine starts rotating only at a time b. The machine is feedback controlled to rotate at a speed $b_0$, but actually the machine speed settles at the speed $b_0$ after it has experienced an overshoot and an undershoot during the rising period of the speed. The clutch current is turned on and off with a suitable duty cycle in accordance with the detected speed. The application of a load for its thread trimming operation is started at a time e and the machine speed starts decreasing. The clutch current increases correspondingly and the machine speed drops to a speed $b_2$. When the thread trimming load terminates, the machine speed is restored and is stabilized at the speed $b_0$. An upper needle position signal is generated at a time f (corresponding to the time $t_4$ in FIG. 1) so that the clutch is de-energized and the brake is energized. The brake current increases in proportion to the inductance of the brake coil. When the brake current has increased to provide a certain amount of amper-turns, the brake ring is attracted so that the application of the braking force starts at a time g. Thereafter, the machine speed decreases along a descending slope corresponding to the inertia of the mechanical system and the braking force, and the machine stops at a time h. A problem exists in the time interval $T_0$ between the generation of the upper needle position signal and the time when the machine speed starts decreasing and the time interval $T_1$ between the end of the time interval $T_0$ and the time when the machine stops. Generally, $T_0=10$ ms and $T_1=20$ ms or so, and the angle of rotation of the machine from the time of generation of the upper needle position signal to the time of the stoppage of rotation of the machine is about 15 degrees. This angle of rotation from the signal generation to the stoppage of the machine rotation varies in dependence upon various factors as mentioned below, and the variation determines the needle positioning accuracy.

(1) The machine speed at the time of application of a stop signal

The machine is feedback controlled to maintain its speed at $b_0$. However, there occurs a deviation of the machine speed from the speed $b_0$ such as a speed drop caused by the application of a thread trimming load immediately before the application of a stop signal, an over-shoot caused by the reaction of the speed drop, and the like. The magnitude of the thread trimming load varies depending on the thickness of the thread and the manner in which the thread is trimmed, so that the machine speed varies correspondingly.

(2) The variation of the power supply voltage

The rate of rise of the brake current increases with an increase of the power supply voltage, which naturally reduces the time intervals $T_0$ and $T_1$.

(3) The temperature variation

The brake coil current and the friction coefficient of the friction member decrease as the temperature of the brake mechanism rises, with the result that the braking force decreases and the time intervals $T_0$ and $T_1$ increase.

The needle positioning accuracy varies in dependence on the above-mentioned various factors, and the deviation of the angle of rotation of the machine with respect to the desired needle stopping position is generally on the order of $\pm 5$ degrees. This deviation presents a main cause of machine malfunctions such as the slipping-off of a thread, the breakage of a needle or the like.

Figure 3:
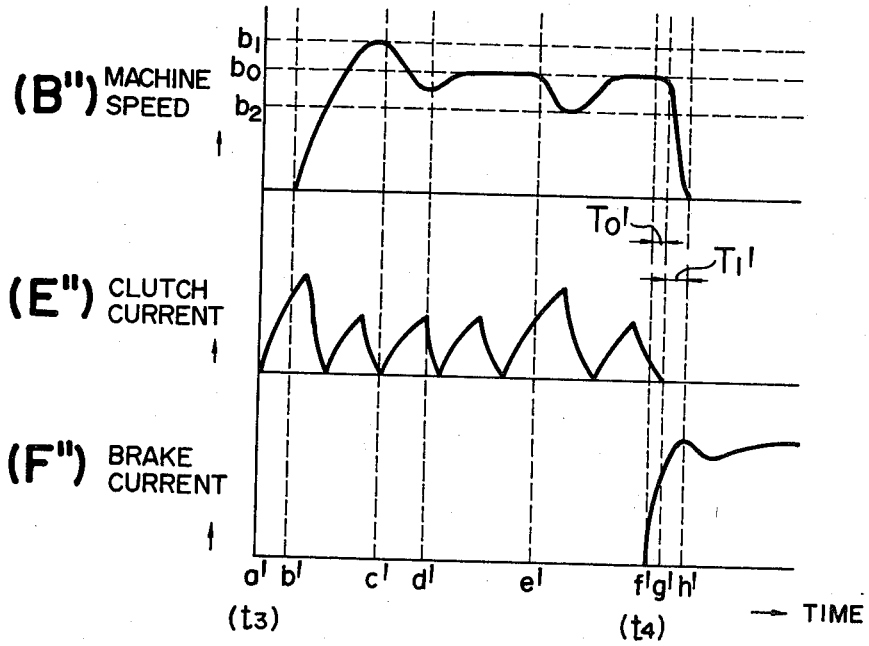
FIG. 3 is a diagram showing operational characteristics of an apparatus according to this invention which corresponds to FIG. 2.

It becomes apparent from the above-described analysis of the problems involved in the state of the art that the most important factor for the improvement of the needle positioning accuracy is to decrease the time intervals $T_0$ and $T_1$ thereby to decrease the so-called slipping angle from the generation of a needle stopping position signal to the actual stoppage of the machine. The present invention has been made from this point of view, and the invention will now be described with reference to FIGS. 3 and 4 showing a preferred embodiment thereof.

Figure 4:
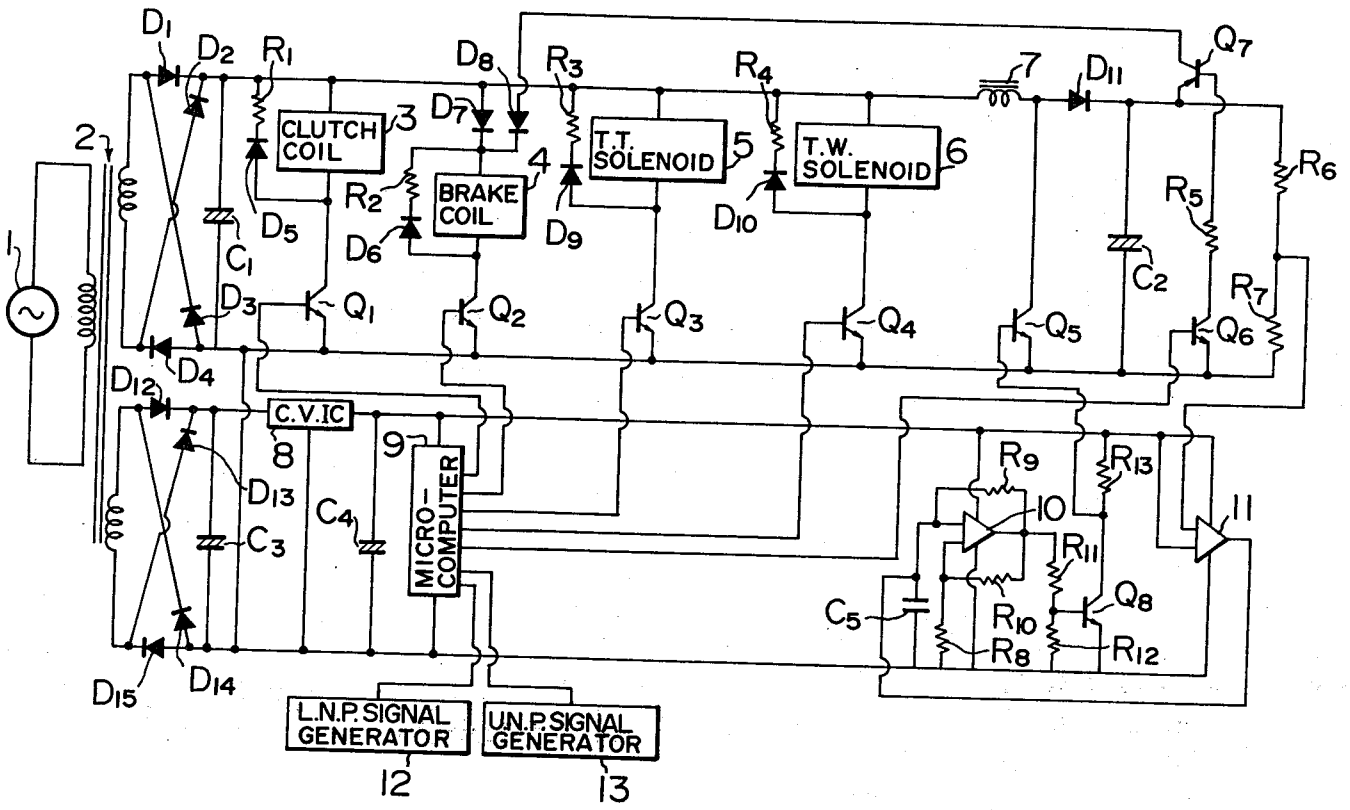
FIG. 4 is a circuit diagram of an electric sewing machine driving apparatus according to an embodiment of this invention.

Referring first to FIG. 4, numeral 1 designates an AC power source, 2 a power transformer, 3 a clutch coil (an inductor), 4 a brake coil, 5 a thread trimming solenoid, 6 a thread wiping solenoid, 7 a choke coil, 8 a constant voltage IC, 9 a microcomputer, 10 an OP AMP (operational amplifier), 11 a comparator, 12 a lower needle position signal generator, 13 an upper needle position signal generator, $D_1$ to $D_{15}$ diodes, $Q_1$ to $Q_8$ transistors, $C_1$ to $C_5$ capacitors, and $R_1$ to $R_{13}$ resistors. An upper power supply line serves as a load driving power source having a large current capacity and an unstabilized power supply voltage of DC 24 V is generated between the terminals of the capacitor $C_1$. A lower power supply line serves as a control power source having a small current capacity and a stabilized power supply voltage of DC 5 V is generated between the terminals of the capacitor $C_4$. Both power sources are connected respectively to a common ground potential line. The microcomputer 9 is supplied with a lower needle position signal from the lower needle position signal generator 12, an upper needle position signal from the upper needle position signal generator 13, and other signals such as a pedal position signal and a speed signal, which are not shown, and generates signals for driving the respective load transistors. Under the control of the output signal from the microcomputer 9, the transistor $Q_1$ is turned on and off to cause an interrupted current to flow through the clutch coil 3 as shown in (E) of FIG. 1. The resistor $R_1$ and the diode $D_5$ from a flywheel circuit which regulates a decrease in the interrupted current. In the like manner, the thread trimming solenoid 5 and the thread wiping solenoid 6 are controlled respectively as shown in (G) and (H) of FIG. 1 under the control of the output signals from the microcomputer 9. The combinations of the resistor $R_3$ and the diode $D_9$; and the resistor $R_4$ and the diode $D_{10}$ form respective flywheel circuits.

The OP AMP 10 forms a multivibrator. For instance, if the relationship between the resistors is selected as $R_8=0.86\ R_{10}$, the multivibrator generates a rectangular wave output having a repetition frequency $f=1/(2C_5 \cdot R_9)$ (Hz). The transistor $Q_8$ connected to the output of the OP AMP 10 and the transistor $Q_5$ connected to the output circuit of the transistor $Q_8$ are respectively turned on and off with this repetition frequency. The transistor $Q_5$, the choke coil 7, the diode $D_{11}$ and the capacitor $C_2$ form a booster type chopper circuit. The electromagnetic energy stored in the choke coil 7 while the transistor $Q_5$ is conducting discharges through the diode $D_{11}$ to charge the capacitor $C_2$ upon the turning-off of the transistor $Q_5$. If T denotes an oscillation period of the transistor $Q_5$, $T_{OFF}$ an "OFF" period of the transistor $Q_5$, $V_{c1}$ a voltage across the capacitor $C_1$, and $V_{c2}$ a voltage across the capacitor $C_2$, then the relation $V_{c2}=V_{c1} \cdot T/T_{OFF}$ holds, which shows that the chopper circuit generates an output voltage higher than an input voltage thereto.

The comparator 11 operates as a voltage comparator. The voltage across the capacitor $C_2$ is divided by the resistors $R_6$ and $R_7$ and the divided voltage is applied to the comparator 11. When the capacitor $C_2$ is charged to reach a predetermined voltage thereacross, the output of the comparator 11 supplies a clamping voltage between the terminals of the capacitor $C_5$, so that the oscillation of the OP AMP 10 stops and the transistor $Q_5$ is held nonconductive. When this occurs, the capacitor $C_2$ stays in a charged state with the voltage thereacross remaining at the level of the predetermined voltage. Thereafter, when the charged voltage across the capacitor $C_2$ decreases to reach a given level due to its self-discharge and the discharge through the circuit comprising the resistors $R_6$ and $R_7$, the OP AMP 10 again starts oscillating and the capacitor $C_2$ is recharged.

Thereafter, when a stop signal is generated from the microcomputer 9 at the time $t_4$ in FIG. 1 (corresponding to a time f' in FIG. 3), the transistors $Q_6$ and $Q_7$ are turned on. At this time the transistor $Q_2$ is also turned on simultaneously, so that the charge stored in the capacitor $C_2$ discharges through the brake coil 4 via the transistor $Q_7$ and the diode $D_8$. The discharge of the capacitor $C_2$ lowers the voltage across the capacitor $C_2$. When the voltage across the capacitor $C_2$ becomes lower than the voltage across the capacitor $C_1$, the source of power supply to the brake coil 4 is switched from the capacitor $C_2$ to the upper power supply line. The charged voltage across the capacitor $C_2$ is preset to a level which is considerably higher than the voltage across the capacitor $C_1$. Consequently, a considerably higher rate of rise of the brake coil current is obtained by the discharge of the capacitor $C_2$ as seen from the waveform shown at (F'') of FIG. 3. As a result, the time interval $T_0$ between the time of application of a stop signal and the time when the machine speed starts falling and the time interval $T_1$ between the above latter time and the time when the machine comes to a standstill are reduced greatly as shown by $T_0'$ and $T_1'$ in FIG. 3, respectively, and the deceleration of the machine rotation is increased as shown at (B'') of FIG. 3. Thus, the so-called slipping angle between the position of the generation of the stop signal and that of the actual stoppage of the machine is decreased greatly as compared with that of a conventional machine, whereby the needle positioning accuracy is improved for the above-mentioned reasons.

In the design of the apparatus of this invention; the capacitance and the charged voltage of the capacitor $C_2$ are important factors. It is necessary that the discharged energy of $\frac{1}{2}\cdot C_2\ (V^2_{c2}-V^2_{c1})$ takes a sufficient value for driving the brake coil 4. Experiments showed that by selecting $V_{c1}=24$ V, $V_{c2}=72$ V and $C_2=1{,}000$ $\mu$F., a satisfactory result was obtained such that the so-called slipping angle between the position of the generation of the stop signal and that of the actual stoppage of the machine was reduced to about 8° as compared with the value of about 15° for a conventional machine, whereby the needle positioning accuracy in terms of a rotational angle was greatly improved from ±5° for a conventional machine to ±3° obtainable by the use of the apparatus of this invention.

On the other hand, since the comparator 11 operates to control the charged voltage of the capacitor $C_2$ at a constant level in spite of variations in the power supply voltage, variations in the power supply voltage do not cause any change of the braking force and consequently any deviation of the stopping position.

Further, the operation of the thread wiping solenoid 6 is usually of the pattern shown at (H) of FIG. 1. In other words, it is programmed so that the solenoid 6 is turned on during several tens milliseconds from the time of generation of the final upper needle position signal. Thus, the turning-on of the transistor $Q_7$ to discharge the capacitor $C_2$ in synchronism with the generation of the upper needle position signal is useful in simplifying the circuit construction.

While, in the embodiment described above, the booster type chopper circuit is used to charge the capacitor $C_2$ to a high voltage, the present invention is not limited to this means. For instance, there are other known means of the similar kind which are called as switching regulators or ringing converters, and even the simplest means, in which the power transformer 2 is provided with an additional secondary winding to generate a high voltage, may be used. Of course, these known means fall within the scope of the present invention.

Further, while, in the above-described embodiment, the charged voltage of the capacitor $C_2$ is selected to be high and controlled at a constant value, the present invention is not limited to the construction which controls the charged voltage of the capacitor $C_2$ at a constant value. It is because that, even if the charged voltage of the capacitor $C_2$ is not controlled at a constant value but it is increased to take a sufficiently high value, it is possible yet to obtain a satisfactory effect in reducing the so-called slipping angle before the actual stoppage of the machine thereby to improve the needle positioning accuracy, and besides it does not depart in any way from the scope of this invention.

It will thus be seen from the above-described embodiment that the present invention provides an electric sewing machine driving apparatus in which the charge of a capacitor, which has been charged beforehand to have a high voltage thereacross, is discharged through a brake coil to reduce the so-called slipping angle between the position of the generation of a stop signal and that of the actual stoppage of the sewing machine and thereby to improve the needle positioning accuracy of the sewing machine, and that the present invention brings a great advantage to assure satisfactory needle positioning accuracy of the sewing machine in spite of various external varying conditions such as variations in the thread trimming load, power supply voltage and ambient temperature, thereby preventing the occurrence of machine troubles such as the slipping-off of a thread and the breakage of a needle even when the apparatus of this invention is applied to any type of sewing machines.

What is claimed is:

1. An electric sewing machine driving apparatus comprising:

a clutch coil of an electromagnetic clutch for transmitting a torque of a motor to a sewing machine to drive the same;

a brake coil of an electromagnetic brake for applying a braking force to said sewing machine;

means for generating a needle position signal to stop said sewing machine at a predetermined needle position;

a DC power source for energizing said clutch coil and said brake coil;

means for generating a DC voltage higher than a supply voltage of said DC power source; and a capacitor disposed to be charged by said voltage generating means; whereby an electric charge stored in said capacitor is caused to discharge through said brake coil to energize the same in response to said needle position signal generated by said needle position signal generating means.

2. An apparatus according to claim 1, wherein the charged voltage of said capacitor is controlled at a predetermined voltage level.

3. An apparatus according to claim 1, wherein said voltage generating means comprises an inductor element and a switching means for switching said inductor element to be energized or de-energized.

4. An apparatus according to claim 1, wherein said capacitor is intermittently charged by said voltage generating means and said intermittent charging is stopped when the charged voltage of said capacitor reaches a predetermined voltage level.

5. An apparatus according to claim 1, wherein a power source for energizing said brake coil is switched from the electric charge in said capacitor to said DC power source when the voltage across said capacitor has become lower than the supply voltage of said DC power source.

6. An electric sewing machine driving apparatus comprising:

a clutch coil of an electromagnetic clutch for transmitting a torque of a motor to a sewing machine to drive the same;

a brake coil of an electromagnetic brake for applying a braking force to said sewing machine;

means for generating a needle position signal to stop said sewing machine at a predetermined needle position;

a DC power source for energizing said clutch coil and said brake coil;

means for generating a DC voltage higher than a supply voltage of said DC power source;

a capacitor disposed to be charged by said voltage generating means;

a thread trimming solenoid; and a thread wiping solenoid;

whereby an electric charge stored in said capacitor is caused to discharge through said brake coil to energize the same in synchronism with the generation of an electric signal for energizing said thread wiping solenoid.

* * * * *